US011255615B2

(12) United States Patent
Streeter

(10) Patent No.: US 11,255,615 B2
(45) Date of Patent: Feb. 22, 2022

(54) HEAT EXCHANGER FLEXIBLE MANIFOLD

(71) Applicant: Hamilton Sundstrand Corporation, Charlotte, NC (US)

(72) Inventor: James Streeter, Torrington, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 107 days.

(21) Appl. No.: 15/877,855

(22) Filed: Jan. 23, 2018

(65) Prior Publication Data

US 2019/0226773 A1 Jul. 25, 2019

(51) Int. Cl.
*F28F 9/02* (2006.01)
*F28F 3/02* (2006.01)

(52) U.S. Cl.
CPC ..... *F28F 9/0246* (2013.01); *F28F 3/02* (2013.01); *F28F 9/0268* (2013.01); *F28F 2255/02* (2013.01)

(58) Field of Classification Search
CPC ..... F28F 9/0246; F28F 3/02; F28F 9/0268; F28F 2255/02
USPC ..... 165/166
See application file for complete search history.

(56) References Cited

U.S. PATENT DOCUMENTS 4,352,273 A * 10/1982 Kinsell ..... B64D 13/06 138/32
6,250,380 B1 * 6/2001 Strahle ..... F28D 9/0043 165/167
6,267,176 B1 * 7/2001 Bolla ..... F28D 9/0062 165/166
6,364,007 B1 * 4/2002 Fischer ..... F28D 9/0037 165/166
7,111,673 B2 * 9/2006 Hugill ..... B01D 3/14 165/166
7,866,377 B2 1/2011 Slaughter
9,618,278 B2 4/2017 Denkenberger
9,746,257 B2 8/2017 Fennessy
10,809,007 B2 * 10/2020 Martinez ..... F28F 13/12
2014/0000841 A1 * 1/2014 Baker ..... F28F 17/005 165/59

(Continued)

FOREIGN PATENT DOCUMENTS

DE 102005014385 A1 9/2006
EP 2628845 A1 8/2013

(Continued)

OTHER PUBLICATIONS

European Search Report for European Application No. 19153053.4 dated Jun. 25, 2019; 8 Pages.

*Primary Examiner* — Tho V Duong
*Assistant Examiner* — Raheena R Malik
(74) *Attorney, Agent, or Firm* — Cantor Colburn LLP

(57) ABSTRACT

A heat exchanger is provided. The heat exchanger includes a core that receives a plurality of mediums. The heat exchanger includes a manifold. The manifold includes a first end that receives a first medium of the plurality of mediums. The manifold includes a second end that intersects the core at a manifold/core interface. The manifold includes a plurality of individual layers that provide gradual transitions for the first medium from the first end to the second end to reduce or eliminate discontinuities at the manifold/core interface that cause stress to the heat exchanger.

7 Claims, 4 Drawing Sheets

(56) References Cited

U.S. PATENT DOCUMENTS

| | | | | |
|---|---|---|---|---|
| 2014/0231057 | A1* | 8/2014 | Schalansky | F28F 3/048 165/169 |
| 2016/0231068 | A1 | 8/2016 | Schmitz et al. | |
| 2016/0282061 | A1 | 9/2016 | Veilleux, Jr. et al. | |
| 2016/0341495 | A1 | 11/2016 | Hemker et al. | |
| 2017/0023311 | A1 | 1/2017 | Urbanski | |
| 2017/0089643 | A1* | 3/2017 | Arafat | F28F 7/02 |
| 2017/0146305 | A1 | 5/2017 | Kuczek et al. | |
| 2017/0211896 | A1 | 7/2017 | Schwalm et al. | |

FOREIGN PATENT DOCUMENTS

| | | | |
|---|---|---|---|
| EP | 2980306 | A1 | 2/2016 |
| EP | 3258204 | A1 | 12/2017 |

* cited by examiner

HEAT EXCHANGER FLEXIBLE MANIFOLD

BACKGROUND

Modern aircraft engines and associated systems operate at elevated temperatures and place greater demands on numerous pneumatic components, including heat exchangers. Heat exchangers that operate at these elevated temperatures often have short service lives due to high steady state and cyclic thermal stresses. The stress is caused by multiple system and component drivers including rapid flow and/or temperature transients, geometric discontinuities, stiffness discontinuities, mass discontinuities, and material selection. Inlet and exit manifolds are typically pressure vessels that are welded or bolted at only the exterior perimeter to a heat exchanger core or matrix. Pressure requirements dictate the thickness of these manifolds, usually resulting in a relatively thick header attached to a thin core matrix. This mismatch in thickness and mass, while acceptable for pressure loads, conflicts with the goal of avoiding geometric, stiffness, mass and material discontinuities to limit thermal stress.

BRIEF DESCRIPTION

In accordance with one or more embodiments, a heat exchanger is provided. The heat exchanger includes a core that receives a plurality of mediums. The heat exchanger includes a manifold. The manifold includes a first end that receives a first medium of the plurality of mediums. The manifold includes a second end that intersects the core at a manifold/core interface. The manifold includes a plurality of individual layers that provide gradual transitions for the first medium from the first end to the second end to reduce or eliminate discontinuities at the manifold/core interface that cause stress to the heat exchanger In accordance with one or more embodiments or the heat exchanger embodiment above, the heat exchanger can comprise a plate and fin heat exchanger or a micro-channel heat exchanger.

In accordance with one or more embodiments or any of the heat exchanger embodiments above, the gradual transitions can be constructed via additive manufacturing to provide continuous, homogeneous transitions across the manifold/core interface for the first medium.

In accordance with one or more embodiments or any of the heat exchanger embodiments above, the core can receive the first medium of the plurality of mediums flowing in a first direction and a second medium of the plurality of mediums flowing in a second direction at any angle relative to the first direction.

In accordance with one or more embodiments or any of the heat exchanger embodiments above, the plurality of individual layers can be cantilevered and flexible.

In accordance with one or more embodiments or any of the heat exchanger embodiments above, the first end can comprise an opening that is smaller in size than the second end.

In accordance with one or more embodiments or any of the heat exchanger embodiments above, the heat exchanger can comprise a second manifold comprising a first end intersecting the core at a second manifold/core interface and receiving the first medium of the plurality of mediums from the core.

In accordance with one or more embodiments or any of the heat exchanger embodiments above, the second manifold can comprise a plurality of individual layers providing gradual transitions for the first medium from the first end of the second manifold to the second end of the second manifold to reduce or eliminate discontinuities at the second manifold/core interface that cause stress to the heat exchanger.

In accordance with one or more embodiments or any of the heat exchanger embodiments above, the manifold can comprise a plurality of sub-units, each of which being independent.

In accordance with one or more embodiments or any of the heat exchanger embodiments above, each of the plurality of sub-units can receive a specified portion of the flow of the first medium.

In accordance with one or more embodiments or any of the heat exchanger embodiments above, a first sub-unit of the plurality of sub-units can receive the first medium and at least one other sub-unit of the plurality of sub-units can receive a second medium of the plurality of mediums.

In accordance with one or more embodiments or any of the heat exchanger embodiments above, the heat exchanger can comprise a second manifold comprising a plurality of second sub-units.

In accordance with one or more embodiments or any of the heat exchanger embodiments above, each of the plurality of second sub-units can correspond to one of the plurality of sub-units.

In accordance with one or more embodiments, a heat exchanger is provided. The heat exchanger comprises a plurality of individual layers providing a gradual transition for a first medium from a first end of the heat exchanger to a second end of the heat exchanger to reduce or eliminate discontinuities throughout the heat exchanger that cause stress to the heat exchanger.

In accordance with one or more embodiments or the heat exchanger embodiment above, the heat exchanger can comprise a core between the first and second ends.

In accordance with one or more embodiments or any of the heat exchanger embodiments above, the gradual transitions can provide continuous, homogeneous transitions across the core for the first medium.

In accordance with one or more embodiments or any of the heat exchanger embodiments above, the core can receive the first medium flowing in a first direction and a second medium flowing in a second direction at any angle relative to the first direction.

In accordance with one or more embodiments, a heat exchanger is provided. The heat exchanger comprises a core that receives a plurality of mediums. The heat exchanger comprises a manifold comprises a plurality of sub-units, each of which comprising: a first end receiving a first medium of the plurality of mediums, a second end intersecting the core at a manifold/core interface, and a plurality of individual layers providing gradual transitions for the first medium from the first end to the second end to reduce or eliminate discontinuities at the manifold/core interface that cause stress to the heat exchanger.

In accordance with one or more embodiments or the heat exchanger embodiment above, each of the plurality of sub-units can be joined.

In accordance with one or more embodiments or any of the heat exchanger embodiments above, the gradual transitions can provide continuous, homogeneous transitions across the core for the first medium.

BRIEF DESCRIPTION OF THE DRAWINGS

The following descriptions should not be considered limiting in any way. With reference to the accompanying drawings, like elements are numbered alike.

DETAILED DESCRIPTION

Embodiments relates to a heat exchanger including a heat exchanger manifold divided into individual layers that extend from passages of a heat exchanger core and transition gradually to heat exchanger inlet(s) and outlet(s).

Figure 1:
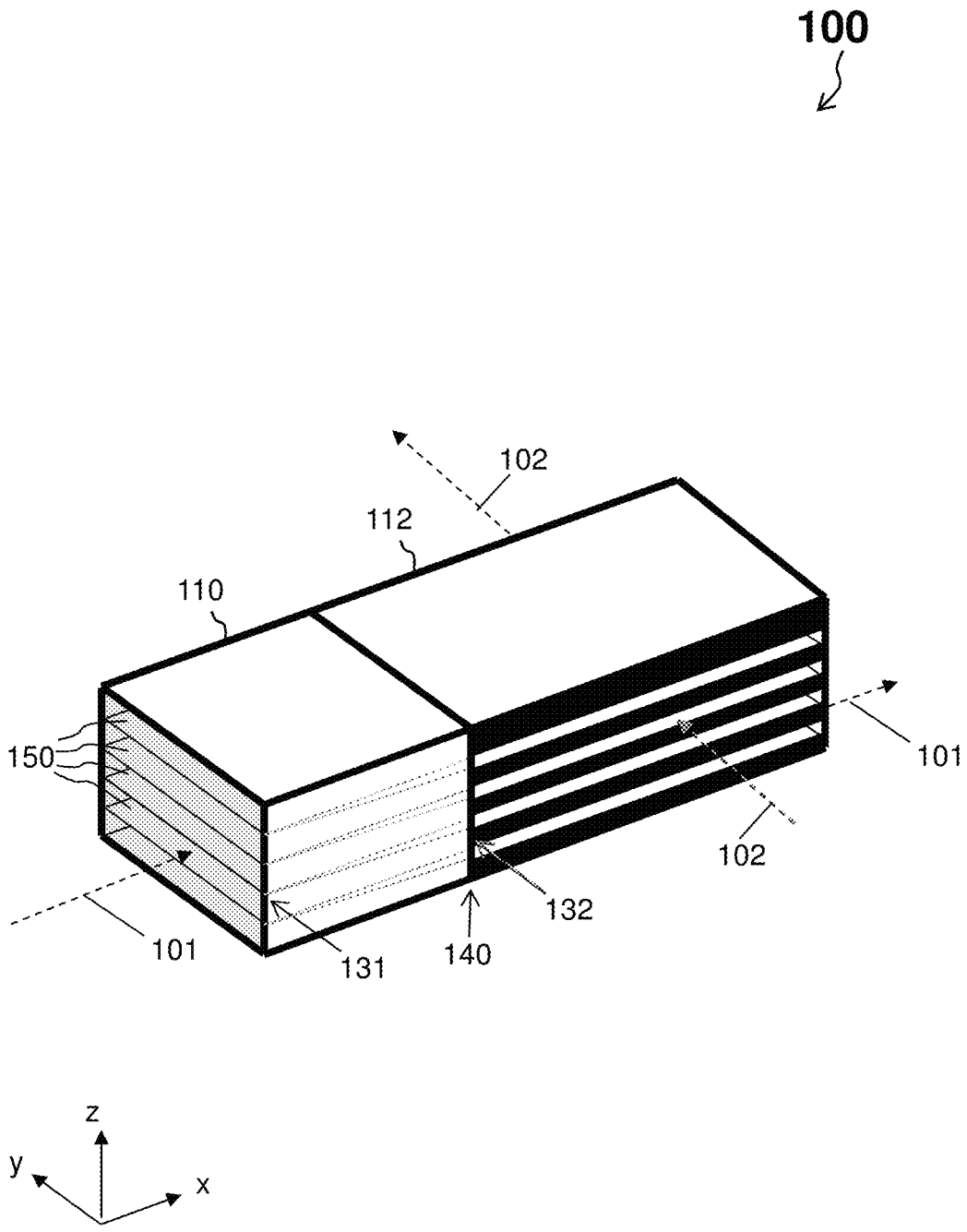
FIG. 1 depicts a heat exchanger according to one or more embodiments.

Turning now to FIG. 1, a heat exchanger 100 is depicted according to one or more embodiments. The heat exchanger 100 can be a plate and fin heat exchanger that receives a plurality of mediums, such as a first medium flowing in a first direction and a second medium flowing in a second direction at any angle relative to the first direction. For instance, a first medium 101 flows in an x-direction through the heat exchanger 100 and a second medium 102 flows in a y-direction through the heat exchanger 100. The heat exchanger 100 can also be any other type of heat exchanger that, generally, consists of alternating layers (e.g., micro-channel heat exchangers). The heat exchanger 100 can include a manifold 110 and a core 112. The manifold 110 includes a first end 131 and a second end 132. The first end 131 can receive or be coupled to a duct, pipe, or the like to receive the first medium 101 (and thus be sized according). The second end 132 intersects the core 112 at a manifold/core interface 140. The manifold 110 includes individual layers 150. In accordance with one or more embodiments, the individual layers 150 of the manifold 110 provide gradual transitions from the first end 131 to the second end 132 (note the dashed line in the x-direction indicating the widening of the layers to provide continuity between the manifold 110 and the core 112). The gradual transitions to reduce or eliminate discontinuities that cause high stress to the heat exchanger 100, which can lead to a short service life of the heat exchanger 100.

Figure 2:
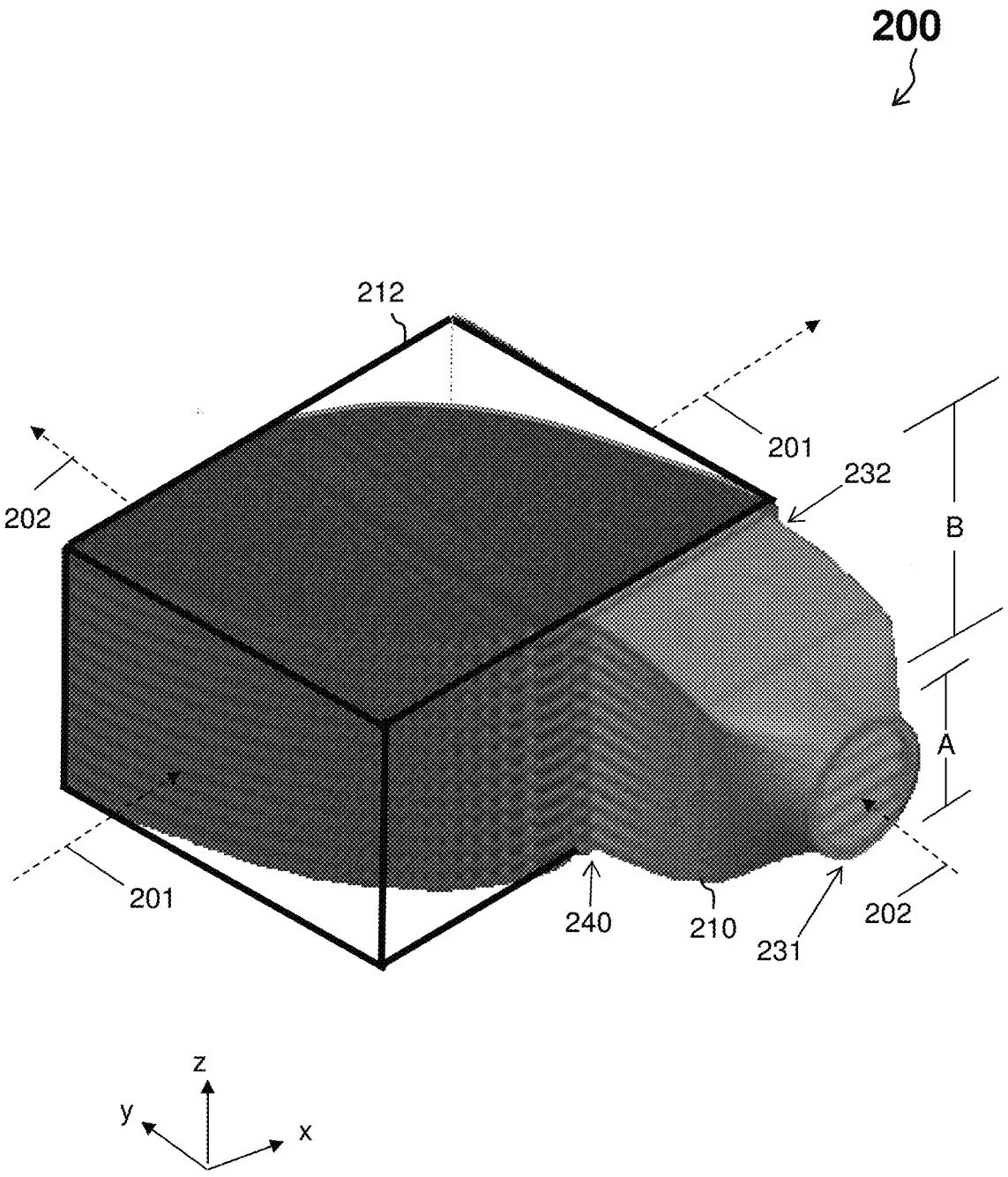
FIG. 2 depicts a heat exchanger according to one or more embodiments.

According to one or more embodiments, FIG. 2 depicts a heat exchanger 200. The heat exchanger 200 can be a plate and fin heat exchanger or a micro-channel heat exchanger that receives a plurality of mediums, such as a first medium 201 flowing in an x-direction through the heat exchanger 200 and a second medium 202 flowing in a y-direction through the heat exchanger 200. The heat exchanger 200 can include a manifold 210 and a core 212. The manifold 210 includes a first end 231 and a second end 232, where the second end 232 intersects the core 212 at a manifold/core interface 240. The manifold 210 includes individual layers. The individual layers of the manifold 210 are gradual transitions (i.e., continuous, homogeneous transitions) from the first end 231 to the second end 232 to reduce or eliminate discontinuities that cause high stress to the heat exchanger 100, which can lead to a short service life. As shown, a first end 231 can include an opening of a size A (sized for coupling to a duct, pipe, or the like to receive the first medium 201) that is smaller than a size B of the second end 232 at the manifold/core interface 240. Size A can be a diameter of a circular opening of the first end 231. Size B can be a height of an opening of the second end 232.

Embodiments of the heat exchanger 200 can leverage additive manufacturing or any other manufacturing method or methods (e.g., casting) that allows to construct the continuous, homogeneous transitions between the core 212 and the manifold 210 (e.g., across the manifold/core interface 240). That is, as the heat exchanger 200 (e.g., the manifold 210 and the core 212) is constructed as an integral homogeneous assembly via additive manufacturing, discontinuities in material properties between the manifold 210 and the core 212 that affect stiffness and thermal stress can be eliminated. In this regard, embodiments of the heat exchanger 200 include the technical effects and benefits of eliminating a geometric, stiffness, mass and material discontinuity at the manifold/core interface 240 (where welds or bolted flanges are required in conventional heat exchangers).

For example, there is no interface tolerance stack in a no-flow direction to design for. Individual layers of the manifold 210 eliminate a stiff, thick, perimeter-connected conventional manifold at a core interface. The individual layers of the manifold 210 can be cantilevered and flexible, unlike the conventional manifold, and allow for a more gradual thermal mass gradient. Flow of the first medium 201 across the Individual layers of the manifold 210 is guided to the plates of the core 212 to fine-tune thermal performance, reduce pressure drop, and/or modify stress results. In contrast, flow in conventional headers follows the path of least resistance and may not provide a uniform distribution through the core, resulting in an underperforming unit or one that is oversized and heavier than necessary.

Figure 3:
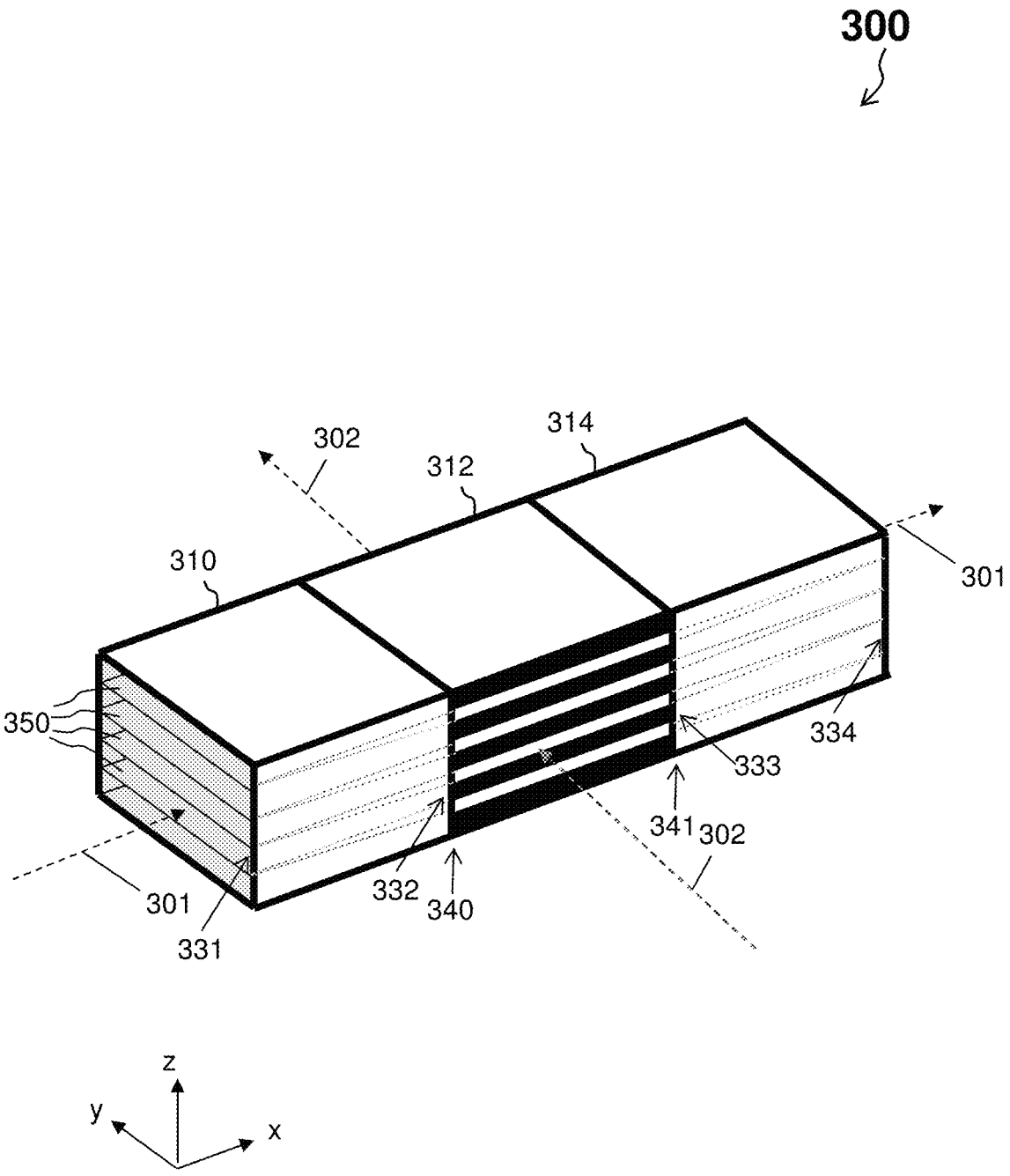
FIG. 3 depicts a heat exchanger according to one or more embodiments.

Turning now to FIG. 3, a heat exchanger 300 is depicted according to one or more embodiments. The heat exchanger 300 can be a plate and fin heat exchanger or a micro-channel heat exchanger that receives a plurality of mediums, such as a first medium 301 flowing in an x-direction through the heat exchanger 300 and a second medium 302 flowing in a y-direction through the heat exchanger 300. The heat exchanger 300 can include a first manifold 310, a core 312, and a second manifold 314. The first manifold 310 includes a first end 331 and a second end 332 and the second manifold 314 includes a first end 333 and a second end 334. The second end 332 of the first manifold 310 intersects the core 312 at a manifold/core interface 340. The first end 333 of the second manifold 314 intersects the core 312 at a manifold/core interface 340. The first and second manifolds 310, 314 include individual layers. Note the dashed line in the x-direction indicating the layer continuity and gradual transitions between the first and second manifolds 310, 314 and the core 312. In this regard, the individual layers of the first manifold 310 provide gradual transitions from the first end 331 to the second end 332 and the individual layers of the second manifold 314 provide gradual transitions from the first end 333 to the second end 334 to reduce or eliminate discontinuities that cause high stress to the heat exchanger 300, which can lead to a short service life of the heat exchanger 300.

Figure 4:
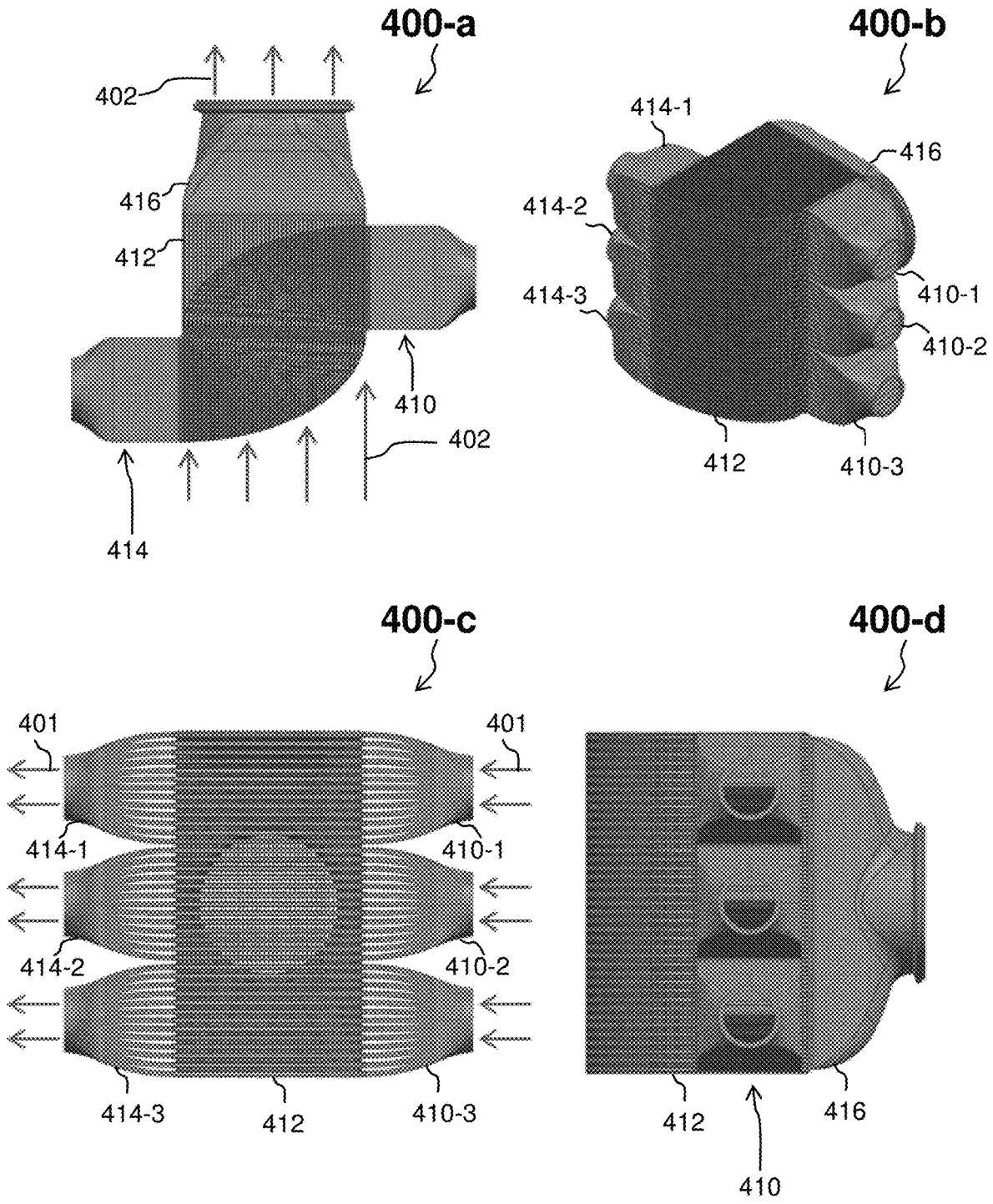
FIG. 4 depicts a heat exchanger according to one or more embodiments.

FIG. 4 depicts a heat exchanger 400 according to one or more embodiments. The heat exchanger 400 is shown in four different perspectives 400-*a*, 400-*b*, 400-*c*, and 400-*d*. The heat exchanger 400 comprises can be a plate and fin heat exchanger or a micro-channel heat exchanger that receives a plurality of mediums, such as a first medium 401 and a second medium 402. The heat exchanger 400 can include a first manifold 410, a core 412, and a second manifold 414. The first manifolds and the second manifolds 414 includes individual layers that provide gradual transitions (i.e., continuous, homogeneous transitions) for receiving and exhausting the first medium 401 to reduce or eliminate discontinuities that cause high stress to the heat exchanger 400.

The first manifold 410 can comprise a plurality of first sub-units (sub-manifolds), such as a sub-unit 410-1, a sub-unit 410-2, and a sub-unit 410-3, each of which can be independent of the other(s). The second manifold 414 can comprise a plurality of second sub-units (sub-manifolds), such as a sub-unit 414-1, a sub-unit 414-2, and a sub-unit 414-3, each of which can be independent of the other(s). Note that while three sub-units are shown in FIG. 4 for each of the first manifold 410 and the second manifold 414, this embodiment is not limiting (as the heat exchanger can be expanded to fit more or less sub-units). Alternatively, the sub-manifolds can be connected to one another, eliminating the discontinuity between the sub-manifolds. For instance, in simulation, when an inlet/outlet consists of sub-manifolds there can be a discontinuity between sub-units. In turn, the manifolds are joined to eliminate this discontinuity.

In accordance with one or more embodiments, each sub-unit 410-1, 410-2, and 410-3 can receive a portion of the flow of the first medium 410 (in specified parts, such as equal parts or otherwise). Further, in accordance with one or more embodiments, each sub-unit 410-1, 410-2, and 410-3 can receive a different medium.

In accordance with one or more embodiments, the sub-units 414-1, 414-2, and 414-3 respectively correspond to the sub-units 410-1, 410-2, and 410-3. Each sub units can be independently sized and/or configured to provide gradual transitions distinct from the other sub-units.

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A heat exchanger comprising:

a core that receives a plurality of mediums;

a first manifold comprising a plurality of first independent sub-units receiving a specified portion of a flow of a first medium of the plurality of mediums, each of the plurality of first independent sub-units comprising a first end receiving the specified portion of the first medium, a second end intersecting the core at a first manifold/core interface, and a plurality of first individual layers within each of the plurality of first independent sub-units that are cantilevered and flexible, the plurality of first individual layers providing gradual transitions for the specified portion of the first medium from the first end to the second end to reduce or eliminate discontinuities at the first manifold/core interface that cause stress to the heat exchanger, wherein the first manifold/core interface is on a first side of the core; and a second manifold comprising a first end intersecting the core at a second manifold/core interface on a second side of the core and receiving the specified portion of the flow of the first medium of the plurality of mediums from the core, the second manifold comprising a plurality of second independent sub-units, each of the plurality of second independent sub-units comprising a plurality of second individual layers within that provide gradual transitions for the first medium from the first end of the second manifold to a second end of the second manifold to reduce or eliminate discontinuities at the second manifold/core interface that cause stress to the heat exchanger, wherein the plurality of first individual layers and the plurality of second individual layers are constructed via additive manufacturing to provide continuous, homogeneous transitions across the first and second manifold/core interface for the first medium, and adjacent ones of the plurality of first individual layers share one of a plurality of barriers that defines a volume of each of the adjacent ones of the plurality of first individual layers from the first end to the second end.

2. The heat exchanger of claim 1, wherein the heat exchanger comprises a plate and fin heat exchanger or a micro-channel heat exchanger.

3. The heat exchanger of claim 1, wherein the core receives the first medium of the plurality of mediums flowing in a first direction and a second medium of the plurality of mediums flowing in a second direction at any angle relative to the first direction.

4. The heat exchanger of claim 1, wherein the first end comprises an opening that is smaller in size than the second end.

5. The heat exchanger of claim 1, wherein a first sub-unit of the plurality of independent sub-units receives the first medium and at least one other sub-unit of the plurality of independent sub-units receives a second medium of the plurality of mediums.

6. The heat exchanger of claim 1, wherein each of the plurality of second independent sub-units corresponds to one of the plurality of independent sub-units.

7. The heat exchanger of claim 1, wherein each of the plurality of independent sub-units are joined.

* * * * *